US005189762A

United States Patent [19]

Giancaspro

[11] Patent Number: 5,189,762

[45] Date of Patent: Mar. 2, 1993

[54] REMOVABLE THREADLESS BUTTON APPARATUS

[76] Inventor: Joseph C. Giancaspro, 3136 E. Irwin, Mesa, Maricopa County, Ariz. 85204

[21] Appl. No.: 774,702

[22] Filed: Oct. 9, 1991

[51] Int. Cl.[5] ..... A44B 1/34

[52] U.S. Cl. ..... 24/108

[58] Field of Search ..... 24/104, 103, 106, 107, 24/108

[56] References Cited

U.S. PATENT DOCUMENTS 1,336,243 4/1920 Lee ..... 24/108

FOREIGN PATENT DOCUMENTS 4220 of 1910 United Kingdom ..... 24/108

*Primary Examiner*—James R. Brittain

*Attorney, Agent, or Firm*—H. Gordon Shields

[57] ABSTRACT

Threadless button apparatus includes a button portion and a retainer portion, with the two portions being secured together with a frictional engagement between a stem or shank which extends outwardly from a button and a lock cylinder in the retainer. There is an outwardly extending protuberance on the shank of the button and an inwardly extending ridge portion at the upper part of the lock cylinder in the retainer. The inwardly extending ridge portion receives the outwardly extending protuberance for frictionally securing the two portions of the button together. The outer or distal end of the shank includes a needle nosed portion which curls over in the lock cylinder of the retainer and which straightens out as the button and retainer are separated so that the two elements may be taken apart and may be reused.

5 Claims, 1 Drawing Sheet

REMOVABLE THREADLESS BUTTON APPARATUS

BACKGROUND OF THE INVENTION

1. Field of the Invention

This invention relates to buttons and, in more particularly, to removable button apparatus secured without thread and by a frictional engagement.

2. Description of the Prior Art

U.S. Pat. No. 133,160 (Lane) discloses button apparatus having a retainer with an end that is spread apart to retain the button.

U.S. Pat. No. 303,664 (Prentice) disclose button apparatus in which a button includes a single prong which extends through the fabric, is bent back to form a loop around the fabric and terminates adjacent to the button.

U.S. Pat. No. 650,455 (Dover) discloses a collar button in which the bottom side of the button includes an indented portion and a retainer extends into the indentation and spreads outwardly within the indentation to secure the retainer and the button together.

U.S. Pat. No. 1,378,073 (White) discloses button apparatus in which a retainer element is secured to a button by a bendable prong. The bendable prong extends through an opening in the button and is bent over on a recess in the button to secure the button and the retainer together. A reinforcing washer in disposed in the recess and the prong is bent against the reinforcing element.

U.S. Pat. No. 1,378,108 (Hart) discloses a button and retainer combination that includes bendable prongs of a retainer extending into a recess in the button. The apparatus is similar to the '073 (White) apparatus.

U.S. Pat. No. 1,930,611 (Freter) discloses a tack button in which a button includes a tubular hub with a recess extending into the tubular hub. The outer or bottom edges of the tubular hub roll or curl inwardly to hold a tack portion of the retainer into the recess. The tack portion includes a tip that curls in the recess.

U.S. Pat. No. 2,179,521 (Purinton) discloses another tack button in which a retainer is deformed in the bottom of the button to secure the retainer and button together.

U.S. Pat. No. 2,299,494 (Purinton) discloses a retainer with spiral elements on the outside of a stem that cooperate with similar spiral elements in a recess in the button to secure the button and retainer together.

U.S. Pat. No. 3,892,013 (Gould) discloses a tack button in which the shank or stem of the tack retainer includes a barbed exterior portion that mates with a locking element in the button to secure the two elements together.

U.S. Pat. No. 4,700,435 (Bush) discloses a tack button in which the shank portion of the tack is tapered and which curls within an insert in a button shell to secure the button to fabric. The insert is locked within the button shell, and the shank of the tack retainer extends into the button and against the insert.

U.S. Pat. No. 4,970,766 (Hsiau et al) discloses button apparatus in which a retainer element includes a shank having a plurality of recesses on the exterior of the shank. There is an aperture in the button element, and there are protrusions extending outwardly in the aperture or hole. The recesses on the exterior of the shank mate with the protrusions in the hole of the button to lock the two elements together. The tip of the shank which extends outwardly from the button is broken off.

It will be noted that the button apparatus discussed above, while they primarily include two elements, a button element and a retainer element, are designed for a single locking engagement. That is, they are not designed to be removable or separable. Moreover, in most of the above discussed patents, it is the retainer element which includes a prong or tack element or shank that extends into the button.

The apparatus of the present invention is designed to be removable or replaceable and it is the button element that includes a tack portion for convenience in securing the button in the precise location, as desired. The shank portion of the button is relatively thin so that its entry into cloth is substantially without damage to the cloth and its removal does not leave a hole that may be generally discernable to casual observers.

SUMMARY OF THE INVENTION

The invention described and claimed herein comprises removable and threadless button apparatus which includes a button having a stem or shank extending outwardly from the bottom of the button for engagement with a retainer. The shank includes a needle tip which punctures cloth an extends through the cloth generally between fibers. The retainer includes a recess for receiving the needle tip and the needle tip curls or folds over within the recess. There is a frictional engagement between the retainer and the shank for holding the button in place. However, the frictional engagement is also releasable so that the two portions may be separated for removal of the button, as desired. Under such circumstances, the button element may include a cloth exterior which is changeable so that the button may be used with a variety of different cloth designs, colors, etc.

Among the objects of the present invention are the following:

To provide new and useful button apparatus;

To provide new and useful removable button apparatus;

To provide new and useful button apparatus including a button portion and a retainer portion;

To provide new and useful removable button apparatus in which a button includes a shank having a needle tip which extends through cloth and the shank is frictionally secured to a retainer element; and To provide new and useful two piece button apparatus having a button portion with a shank extending outwardly from the button portion and a protuberance extending outwardly from the shank to engage frictionally with a recess having an inwardly extending portion.

DESCRIPTION OF THE PREFERRED EMBODIMENT

Figure 1:
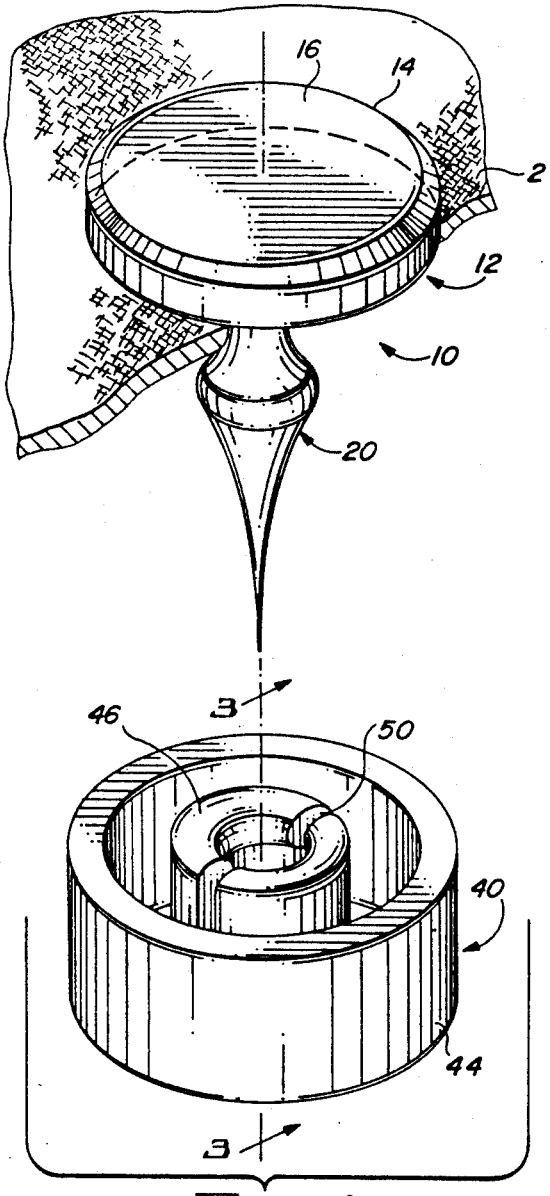
FIG. 1 is an exploded perspective view of the apparatus of the present invention in its use environment.
Figure 2:
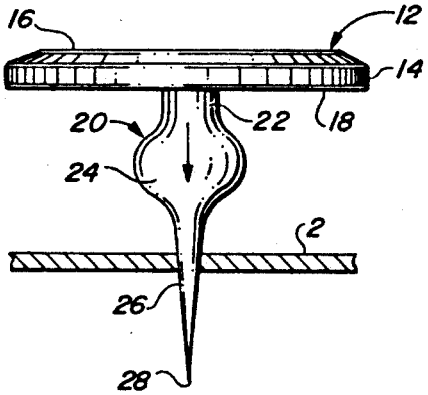
FIG. 2 is a side view of a portion of the apparatus of the present invention.

FIG. 1 is an exploded perspective view of threadless button apparatus 10 of the present invention, with the two major portions thereof, including a button 12 and a lock element 40, spaced apart from each other, and with a portion of the button 12 extending through a layer of fabric or cloth 2. The button 12 includes several portions, including a disk 14, and a fastener needle portion 20 extending downwardly from the button 12. In FIG. 2, the disk 14 of the button 12 is shown above the cloth 2, with a portion of the fastener needle 20 extending into or through the cloth 2.

Figure 3:
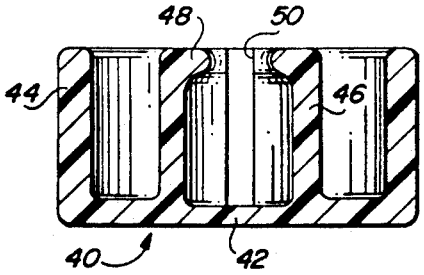
FIG. 3 is a side view in partial section taken generally along line 3—3 of FIG. 1.

FIG. 3 is a side view in partial section of the lock element 40 taken generally along line 3—3 of FIG. 1. The lock element 40 cooperates with the fastener needle portion 20 of the button 12 to secure the button 12 to the cloth 2.

Figure 4:
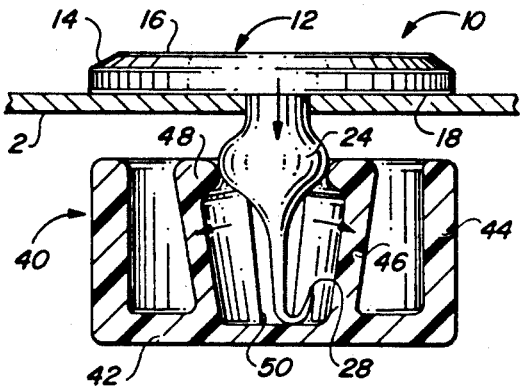
FIG. 4 is a side view illustrating the operation of the apparatus of the present invention.
Figure 5:
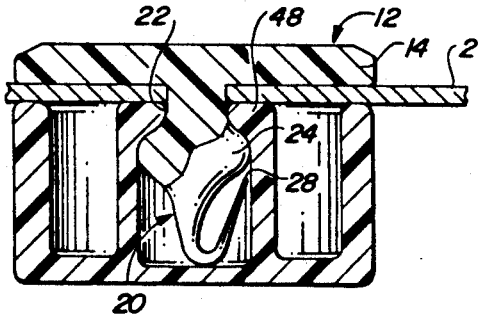
FIG. 5 is a side view in partial section sequentially following the view of FIG. 4 illustrating the operation of the apparatus of the present invention.

The cooperation between the fastener needle portion 20 of the button 12 and the lock element 40 is illustrated sequentially in FIGS. 4 and 5. For the following discussion of the threadless button apparatus 10, reference will be made to all five of the Figures.

As indicated above, the button 12 includes a disk 14 with a fastener needle portion 20 extending downwardly from the disk 14. The disk 14 includes a top outer surface 16 and a bottom surface 18. The bottom surface 18 is preferably generally flat or planar so as to mate in an appropriate manner with the top surface of the cloth or fabric 2. The top surface 16 of the disk 14 is also shown as flat or planar for illustrative purposes. However, it is obvious that the top surface may be configured as desired, or as appropriate, for a particular purpose.

Moreover, the disk 14 need not be round, as illustrated, but may be any appropriate configuration for decorative purposes, depending on the specific or desired utilization of the button 12. Furthermore, it is obvious that the disk 14 may include elements for changing the appearance of the button 12, as desired. The threadless button apparatus 10 of the present invention may be removed from the cloth 2 for subsequent use without damage to the fabric 2, as will be discussed in detail below.

The fastener needle 20 extends downwardly from the bottom surface 18 of the disk 12. The fastener needle 20 includes several portions, including a neck 22, a bulbous portion 24 extending from the neck 22, a needle bottom portion 26 extending downwardly from the bulbous portion, and a tip 28 at the lower or distal end of the needle 26.

The tip 28 is preferably very pointed so as to penetrate the fabric 2 without damage to the threads of the fabric, or with only minimum damage, like to only a single thread or so. Rather, the tip 28 is sharply pointed and the needle bottom 26 is slim so as to simply move the threads or spread the threads to allow the needle bottom 26 to extend into and through the fabric 2.

The bulbous portion 28 comprises a generally concave portion which has a diameter greater than that of the neck 22. For purposes of illustration, the bulbous portion 24 is exaggerated in the Figures. In actuality, the bulbous portion 24 will also extend through the fabric 2 without tearing the fabric but will merely push the fabric threads apart or away from each other to allow for the bulbous portion 24 to extend through the fabric.

The lock element 40 includes a bottom or base 42 and an outer cylindrical wall 44 extending upwardly from the bottom or base 42. Disposed within the outer cylindrical wall 44 is an inner lock cylinder 46. The inner lock cylinder 46 extends upwardly from the bottom or base 42.

The diameter of the outer cylindrical wall 44 is preferably about the same, or slightly less than, the diameter of the disk 14. This relative sizing helps to provide stability for the threadless button apparatus 10 with respect to the cloth 2.

At the upper portion of the inner lock cylinder 46 there is an inwardly extending ridge 48. The ridge 48 cooperates with the neck 22 and the bulbous portion 24 of the fastener needle 20 to secure the button 12 to the lock element 40.

A slot 50 is shown extending axially and diametrically through the inner lock cylinder 46. The purpose of the slot 50 is to help the inner lock cylinder 46 to move outwardly or to expand, as best shown in FIG. 4, as the bulbous portion 24 moves downwardly into the inner lock cylinder 46.

In operation, the tip 28 is positioned adjacent to the cloth 2 at the desired location where the threadless button apparatus 10 is to be secured to the cloth 2. The cloth 2 may be a shirt, blouse, or the like, where a button is desired to be located quickly and efficiently and without the use of permanent threads.

The tip 28 is then inserted into and through the cloth 2, with the needle bottom 26 following the tip. Steady downward pressure on the button 12, as illustrated by the relatively large arrow in FIG. 2, will cause the needle bottom 26 to move through the cloth 2. Continued downward pressure or force will cause the bulbous portion 24 to follow the needle bottom 26 through the cloth 2. This is shown in FIG. 4.

When the bottom surface 18 of the disk 14 is disposed against the cloth 2, the lock element 40 is then moved on the opposite side of the cloth and against the tip 28, the needle bottom 26, and the bulbous portion 24. This is also illustrated in FIG. 4.

As the lock element 40 is moved upwardly against the fastener needle 20, the upper inner ridge 48 is disposed against the bulbous portion 24. The configuration of the bulbous portion 24 and the configuration of the upper inner ridge 48 move the inner lock cylinder 46 outwardly as by cam action. As the maximum diameter portion of the bulbous portion 24 moves downwardly into the inner lock cylinder 46, the resiliency of the inner lock cylinder 46 causes the inner lock cylinder to move back to its original configuration in which the inner ridge 48 is disposed against the neck 22. This is shown in FIG. 5. At such time as the inner ridge 48 is disposed against the neck 22, the cloth 2 is essentially locked between the button 12 and the lock element 40. Or, phrased in another manner, the threadless button apparatus 10 is secured together with the cloth 2 disposed between the button 12 and the lock element 40.

In FIGS. 4 and 5, it is noted that the needle bottom 26 is flexible enough to curl upwardly within the inner lock cylinder 46. As the tip 28 contacts the bottom or base 42 of the lock element 40, the tip 28 will curve or curl within the inner lock cylinder 46. The flexibility of the needle bottom 26 allows for the flexing or curving of the needle bottom 26 without breaking.

At such time as it is desired to separate the lock element 40 from the button 12, the reverse operation is accomplished, namely pulling apart the lock element 40 away from the button 12. When this happens, the needle bottom 26 will straighten out so that the button 12 may be removed from the cloth 2 again without substantial tearing or damaging of the cloth.

The flexing of the needle bottom 26 will allow the needle bottom 26 to straighten out to allow the needle bottom to be pulled away from the cloth 2 without damage to the cloth 2. That is, the needle bottom 26 returns to its generally vertically or axially alignment, as illustrated in FIGS. 1 and 2, and does not remain as a hook or in the hook configuration as illustrated in FIGS. 4 and 5. Thus, the button 12 may be reused, as desired, with the tip 28 and the needle bottom 26 returning to the configuration illustrated in FIGS. 1 and 2 for reuse after being separated from a cloth layer 2.

What I claim is:

1. Threadless button apparatus, comprising, in combination:

button means to be secured to cloth, including a disk, a fastener needle means secured to and extending from the disk, including a neck, a bulbous portion, and a flexible needle bottom having a tip for penetrating the cloth; and lock means for securing the button means to the cloth, including an outer cylinder, a bottom wall secured to the outer cylinder and against which the tip contacts, and an inner cylinder secured to the bottom wall and disposed within the outer cylinder for receiving the fastener needle and in which the flexible needle bottom curls when the tip contacts the bottom wall to secure the button means to the cloth.

2. The apparatus of claim 1 in which the lock means further includes an inner ridge on the inner cylinder remote from the bottom wall for receiving the neck of the fastener needle means.

3. The apparatus of claim 2 in which the bulbous portion and the needle bottom extend into the inner cylinder between the inner ridge and the bottom wall.

4. The apparatus of claim 2 in which the inner cylinder is flexible, and the inner ridge has a first diameter and the bulbous portion of the fastener needle means has a second diameter which is larger than the first diameter, and the inner cylinder and inner ridge are cammed outwardly to receive the bulbous portion within the inner cylinder.

5. The apparatus of claim 1 in which the inner cylinder includes an axially extending slot to allow the inner cylinder to spread outwardly to receive the bulbous portion of the fastener needle means.

* * * * *